US005867194A

United States Patent [19]

Clark et al.

[11] Patent Number: 5,867,194

[45] Date of Patent: Feb. 2, 1999

[54] METHOD AND APPARATUS FOR AUTOMATIC SETTING OF NOZZLE DRIVE VOLTAGE IN AN INK JET PRINTER

[75] Inventors: James E. Clark, Naperville; Philip D. Anderson, Elk Grove Village; Robert I. Keur, Niles, all of Ill.

[73] Assignee: Videojet Systems International, Inc., Wood Dale, Ill.

[21] Appl. No.: 442,005

[22] Filed: May 16, 1995

[51] Int. Cl.[6] ..... B41J 2/02; B41J 2/12; B41J 2/105; B41J 2/125

[52] U.S. Cl. ..... 347/78; 347/73; 347/81; 347/82; 347/80

[58] Field of Search ..... 347/19, 78, 80, 347/81, 82, 77; 342/80, 81, 75, 78, 82, 73

[56] References Cited

U.S. PATENT DOCUMENTS 4,060,813 11/1977 Yamada et al. .

4,878,064 10/1989 Katerberg et al. ..... 347/78

5,196,860 3/1993 Pickell et al. ..... 347/78

*Primary Examiner*—Benjamin R. Fuller

*Assistant Examiner*—Thien Tran

*Attorney, Agent, or Firm*—Rudnick & Wolfe; William T. Rifkin; R. Blake Johnston

[57] ABSTRACT

A method and apparatus for accurately determining and setting the optimal nozzle drive voltage for an ink jet printer. The current carried by charged test drops is monitored by a sensing electrode and ammeter while the nozzle drive voltage is slowly varied between minimum and maximum points. A plot of drop current versus nozzle drive voltage provides an accurate determination of the good printing window for the particular nozzle under the operating conditions presented. This arrangement can be used for calibrating a new nozzle in an existing printer or for calibrating a new ink or font to ensure that operation will occur within the desired print window.

14 Claims, 4 Drawing Sheets

METHOD AND APPARATUS FOR AUTOMATIC SETTING OF NOZZLE DRIVE VOLTAGE IN AN INK JET PRINTER

BACKGROUND OF THE INVENTION

This invention relates to commercial and industrial ink jet printers of the type commonly used for marking of products. Such devices require high speed and high reliability and must operate in somewhat hostile environments in terms of temperature, service intervals and the like. When an ink jet printer is being readied for use, it has been necessary to calibrate the printer for the particular characteristics of the ink and nozzle it is to use. In the prior art, it is known to use certain characteristics of the printing operation to approximate the nozzle drive voltage at which good printing operations can be obtained. For example, it is known to determine the infinite satellite condition and the foldback point of an ink drop stream. The former is a condition in which the small satellites which form between drops, neither forwardly nor rearwardly merge with the main drops. The foldback condition is an upper bound in which the breakoff point of the drops, relative to the nozzle, first reverses. The foldback condition is described more thoroughly in U.S. Pat. No. 5,196,860.

U.S. Pat. No. 5,196,860 to Pickell et al., assigned to the present assignee, detects one or both of these points and then selects a predetermined nozzle drive voltage somewhere between the two bounds. It does not, however, directly determine the true bounds of the print window. It relies on factory data concerning the ink and the nozzle to calculate a voltage that is expected to lie within the print window.

Another prior art method of estimating the drive voltage point within a print window is disclosed in U.S. Pat. No. 4,878,064 to Katerberg et al. In this patent, a D.C. voltage is applied to a drop charging electrode. The stream current is monitored as a function of charging voltage, and when a dip in the detected current appears this indicates that the satellites have been deflected by the deflection electrode. Further operation yields the foldback point from which a nozzle drive voltage is calculated as a fraction of the voltage at the foldback point. Again, this is an estimating technique dependant on factory data and detecting the foldback point.

The present invention, by contrast, is a method of automatically determining the actual nozzle drive "print window", that is, the range of nozzle drive voltages that provide substantially constant deflection of drops (i.e., desirable print quality) for a particular nozzle, ink type, font and stimulation voltage waveform combination. Thus, rather than estimating the print window, the nozzle operation is sampled and used to accurately determine the print window. It is possible therefore, for the first time, to test a printer whenever necessary, for example, upon installing a new nozzle or a different ink, thereby to positively determine the print window or range of nozzle drive values at which the printer can be operated to obtain good printing results.

SUMMARY OF THE INVENTION

According to the invention, a predetermined voltage pattern for charging test drops is employed. The system measures the stream current in a stream of test drops deflected to a sensing electrode. The drop charging pattern is arranged so that uncharged drops follow each charged drop. For proper printing, it is desired that satellites forwardly merge with the drop that they follow, thereby to ensure that the entire charge placed upon a drop at breakoff from the drop stream remains with the drop. If satellites do not forwardly merge or they merge rearwardly, the charge is redistributed and adversely affects the deflection of the drops. In either case, the charge from the non-forwardly merging satellite is not detected by the sensing electrode, and this reduces the current of the deflected drop stream detected by a current electrode. By plotting current for a range of nozzle drive voltage signals, the precise range of nozzle drive values where proper drop charging occurs, can be accurately determined for any given nozzle, ink type, font, stimulation voltage waveform and other variable parameters. The print window is defined as the range of nozzle drive waveform voltages where a substantially constant, maximum stream current is detected.

As such ink jet printers include microprocessors, the calibration routine can be performed at set-up or whenever desired by an operator, for example, when a new nozzle or a different ink is to be used or a different font size is to be printed. The calibration routine may also be automatically called at suitable times when the printer is not required to print.

DETAILED DESCRIPTION

Figure 1:
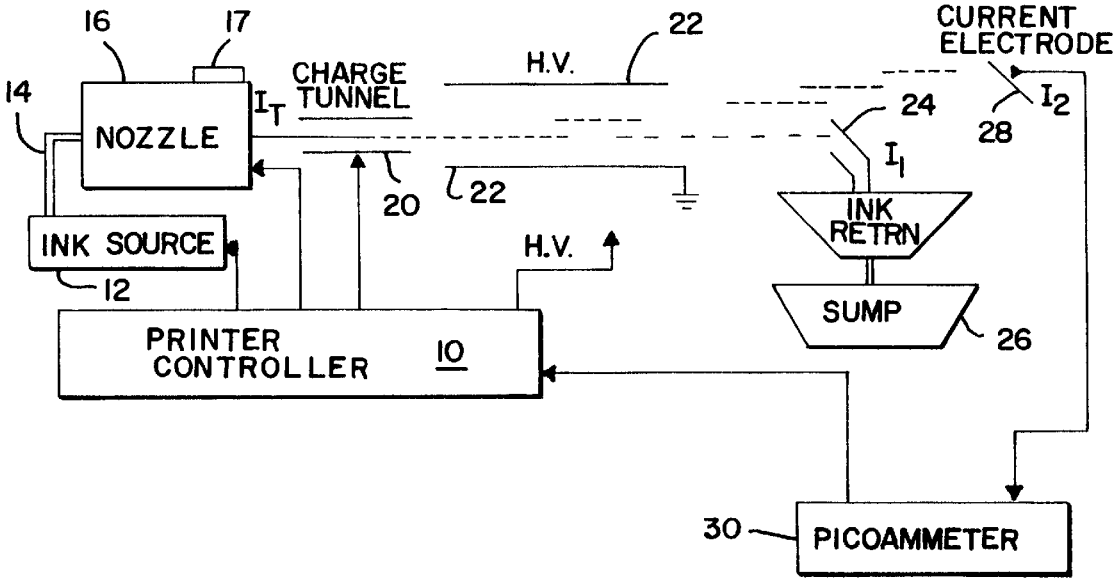
FIG. 1 is a block diagram of an ink jet printer system suitable for use with the present invention.

Referring to FIG. 1, there is illustrated an ink jet printing apparatus suitable for use with the present invention. The printer includes a print controller 10 of the type typically used in this industry. The controller 10 includes a microprocessor or similar device programmed to operate the ink jet printer according to the parameters set by the operator. The controller regulates the supply of ink from a source 12 via an ink supply conduit 14 to a nozzle 16. A stimulation voltage waveform or drive voltage waveform is applied to the nozzle, usually through a piezoelectric device 17, in a manner well known in this art at a frequency selected to cause break up into droplets of the stream of ink 18 ejected from the nozzle. The drop breakoff point is a function of the ink pressure, the nozzle diameter and the magnitude of the applied nozzle drive voltage, among other factors. In order to charge the droplets as they breakoff from the stream 18, it is necessary that the breakoff point occurs within a charge tunnel 20. Charged drops are thereafter deflected by a pair of deflection electrodes 22 in the course of travel toward a substrate to be marked (not shown). That is, drops which carry a charge are deflected onto the substrate while uncharged drops pass undeflected through the electrodes. Preferably, the uncharged drops are directed toward a catcher 24 which returns the ink to a sump 26 and/or to the ink source 12 for reuse. Not shown, but typically included in a standard printer of this type, are fresh ink reservoirs, solvent reservoirs and valves controlled by the controller 10 for maintaining the quality of the ink relatively constant during the course of the printing operation.

From the foregoing, it will be apparent that when drops emerge from the charge tunnel 20, those which have been given an electric charge within the tunnel are deflected while uncharged drops pass to the catcher 24. For purposes of the present invention, it is necessary to create a test pattern of drops wherein each charged drop is separated by one or more uncharged drops commonly known in this art as guard drops. At least one guard drop is required between each charged drop for purposes of the present invention, although several guard drops are typically used.

The automatic nozzle setting function of the invention is accomplished by use of a sensing electrode 28 disposed at the point where the deflected drops would normally reach the substrate to be marked. Obviously, the sensing electrode is in place only during the period of time when the print window is being determined and is thereafter removed so that normal printing can occur. The sensing electrode 28 is connected to a current measuring circuit or device, such as an ammeter 30, or preferably a picoammeter. The current detected by the current measuring device is provided to the print controller 10 which uses this information to determine the print window in the manner described hereafter.

Before proceeding further, it will be useful to understand more precisely what is meant by the term "print window". For that purpose, reference is made to FIG. 2 which illustrates plots of stream current versus nozzle drive voltage as detected by the sensing electrode 28 for three different nozzles. In the nozzle represented by the solid circles, a maximum stream current of approximately seven nanoamps is maintained over nozzle drive voltages from twenty through forty-three. Thus, the print window (PW), or useful printing range for this particular nozzle, is extremely wide and good printing results can be obtained anywhere therein simply by setting the nozzle drive voltage to a value within this window, for example, thirty volts.

In contrast, the nozzle represented by the open circles, has a print window beginning at approximately thirteen volts and terminating at approximately eighteen volts. Thus, the print window for this nozzle is much more limited. It is required, when using such a nozzle, to carefully and precisely set the nozzle drive voltage to a value within the rather narrow print window.

Figure 2:
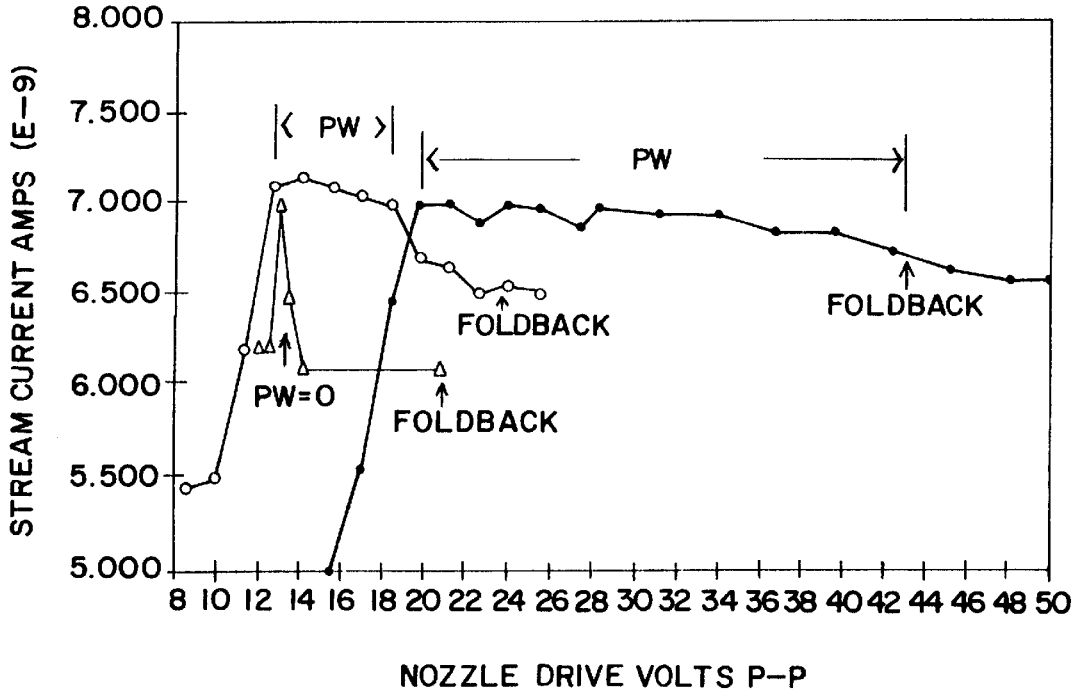
FIG. 2 is a plot of nozzle drive signal versus deflected stream current for three different nozzles, illustrating the detection of the print window.

FIG. 2 shows a third nozzle, which may be considered, for present purposes, to be defective. It is illustrated by the waveform carrying the triangular markers. It can be seen that this nozzle has a peak stream current at approximately thirteen volts, but that it rises to and falls from that value so rapidly that there is no effective print window.

From FIG. 2 the importance of accurately determining the print window for a particular nozzle, type of ink, and font size can be perceived. The ability to accurately and directly determine a print window for any given printer setup ensures that good printing can be maintained for significant periods of time. Failure to accurately set the nozzle drive within the print window can result in variable printing results or poor printing results if the drive setting is set at the edge of a print window or is outside the print window.

Heretofore it has been possible only to estimate the print window for a particular printing system. Such methods locate the foldback voltage for the drop stream (as an approximate upper bound on the print window) and merely estimated where the print window ought to be by using some fraction of the foldback voltage. While usually satisfactory, this method is not as precise and does lead occasionally to less than satisfactory results, particularly when installing a new nozzle or changing inks or font sizes.

Figure 5:
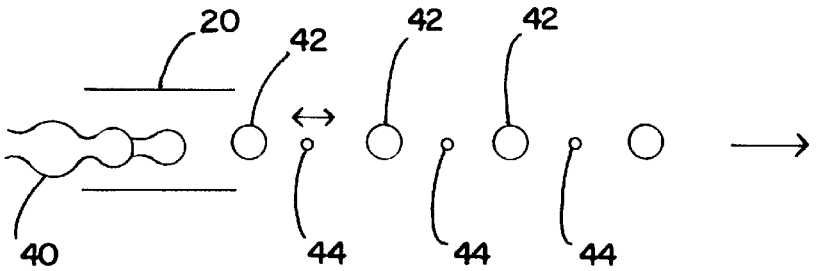
FIG. 5 is an illustration of drop breakoff from an ink stream, useful in understanding the present invention.

According to the present invention, the current of the test drops which have been charged is measured while incrementing the nozzle drive voltage from a minimum value or decrementing the nozzle drive voltage from a maximum value. The print window is accurately determined by recording the stream current versus nozzle drive voltage to determine the voltage range where stream current remains near its maximum value. This is the print window or good printing region for any particular nozzle, ink, and font in most ink jet printers. The reason for this can be understood with reference to FIG. 5. FIG. 5 illustrates the manner in which the stream of ink 18 breaks up into drops 42 and satellites 44. The breakup must occur within the charge tunnel 20 in order for the drops to be properly charged. Assuming that condition, the next issue is whether the satellites 44 are infinite satellites, that is, they remain interleaved between the drops 42 or whether they merge forwardly or rearwardly with the drops 42. The motion of the satellites 44 is a function of the nozzle drive voltage, but is also charge dependent. For proper printing, it is usually desired to have the satellites merge forwardly to ensure that the total charge induced by the charge tunnel 20 is on a particular drop. In that regard, it should be noted that the satellites are simply a small trailing portion of a drop which breaks off therefrom during or after the separation process within the charge tunnel and that in order for the full charge to be detected, each satellite must recombine with its "parent" drop.

In contrast, rearwardly merging satellites deplete the charge that was initially present on a drop and this is detected according to the present invention, as is the infinite satellite condition where the satellites do not recombine. As noted previously, according to the present invention, each charged drop is separated by at least one and preferably several guard drops which carry relatively no charge. Thus, if the satellites are forwardly merging the total charge induced by the charge tunnel will be present on a charged drop when it reaches the sensing electrode 28 in FIG. 1. In the event that the satellites do not forwardly merge because they are infinite or because they are rearwardly merging, the charged drops which are deflected to the sensing electrode 28 will have a lower charge than would otherwise be the case. By collecting drop current data according to the invention, the print window for a particular print set-up can be accurately determined.

Figure 6:
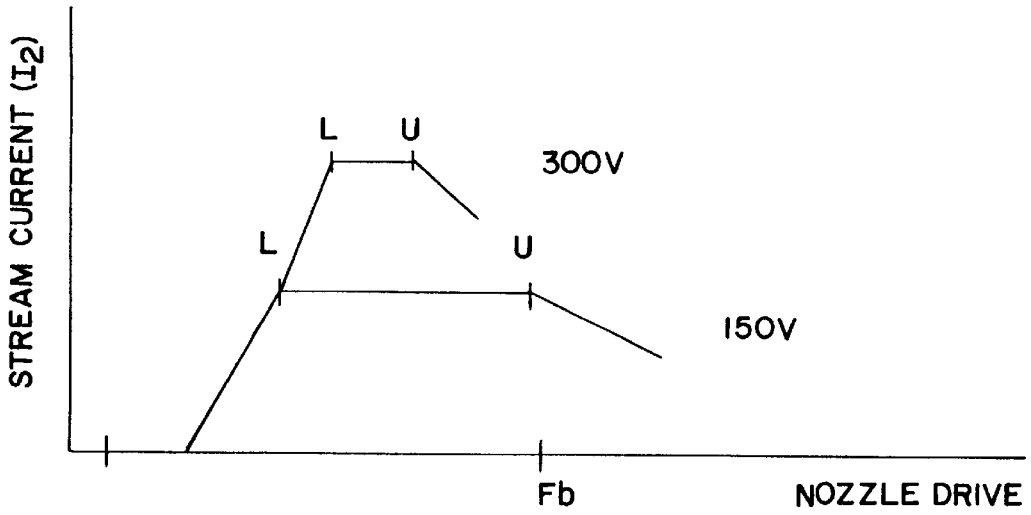
FIG. 6 is a plot illustrating the change in print window as a function of the magnitude of the drop charging voltage.

The upper and lower bounds of the print window are a function of the nozzle drive voltage required to cause the satellites to forwardly merge, although the upper bound of the print window is also charge dependent. If a high charge is applied to the drops, electrostatic repulsion begins to overcome the forward momentum of the satellites, thus reducing the width of the print window. Increased charges are used for increased drop deflection to print large characters. The manner in which a print window changes for different charges applied to the drops can be seen in FIG. 6, which illustrates that the print window for drops charged at 300 volts is markedly smaller than the print window for drops charged at 150 volts. It is for this reason, among others, that the present invention is a significant improvement over the prior art because it measures the actual print window using a particular charge level, ink type and nozzle, thereby precisely determining the good printing range. Prior methods, which only estimate the print window from a determination of the foldback voltage, do not compensate for these conditions resulting in the need for manual readjustments.

Figure 3:
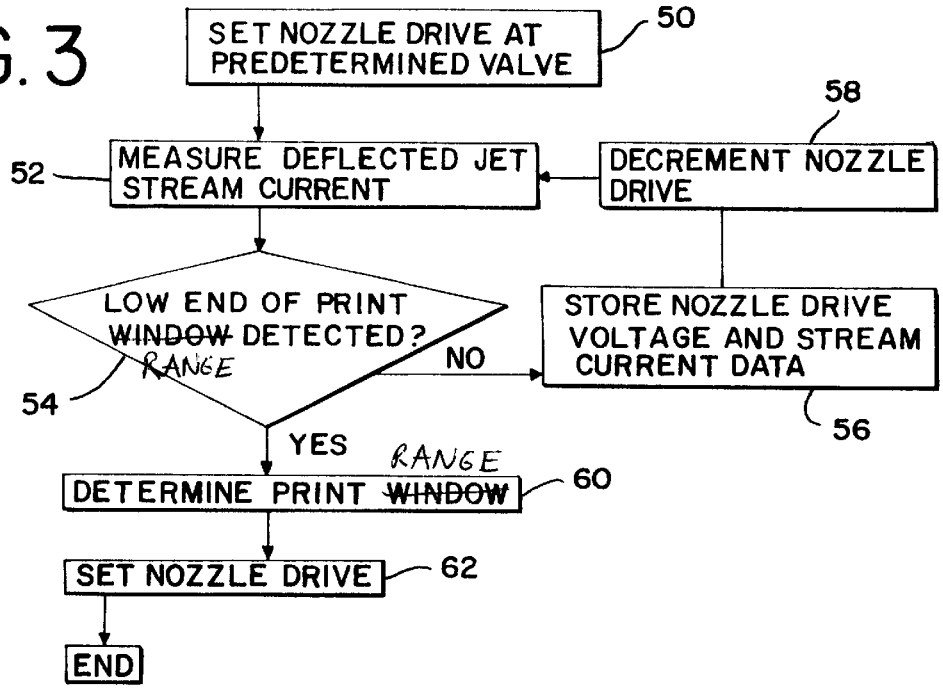
FIG. 3 is a software flow diagram illustrating the manner in which the microprocessor associated with the ink jet printer may be programmed, according to the invention, to detect the print window.
Figure 4:
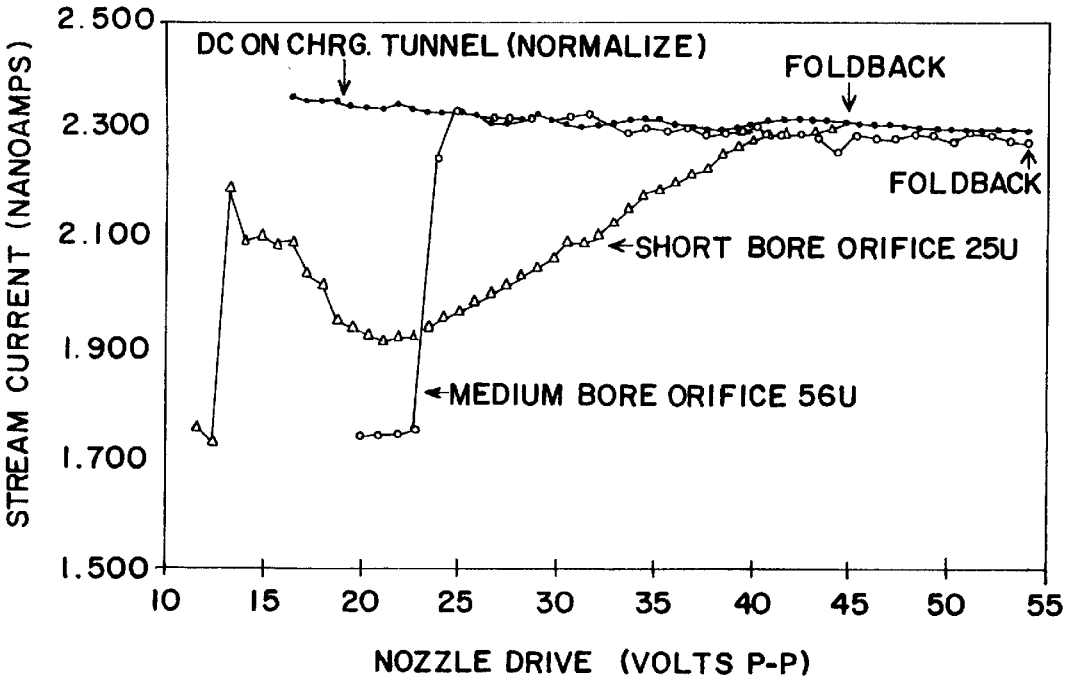
FIG. 4 is a plot of nozzle drive voltage versus stream current illustrating additional capabilities of the invention to detect operating characteristics of different nozzle types.

Referring to FIGS. 1 and 3, the manner in which the print window is determined will now be described. FIG. 3 is a software flow diagram illustrating the manner in which the print controller 10, preferably a microprocessor based device, is programmed to obtain the necessary data. At step 50 the nozzle drive voltage applied to nozzle 16 is set to a predetermined value. The predetermined value will be a voltage greater than the foldback value if the data is to be taken by decrementing the nozzle d rive voltage or it will be a very small value, at or above the infinite satellite voltage, if the data will be taken by incrementing the nozzle drive. It should be noted, as described in U.S. Pat. No. 5,196,860, hereby incorporated by reference, that the infinite satellite condition and the foldback condition can be easily determined automatically or by the operator.

once the nozzle drive has been set at an initial value, the controller causes a set of test drops to be generated in a specified pattern wherein a charge drop is separated by at least one and preferably several, uncharged guard drops. The sensing electrode 28 is placed in a path to intercept the charged drops which are deflected by the high voltage electrode 22 and to route the resulting current to an ammeter 30 for quantification. Thus, at step 52, the deflected jet stream current is measured by the ammeter 30. At 54 a check is made to determine if the subroutine should terminate because it has reached the end of the print window. If this is the first time through, the answer will be "no" and the software branches to 56 where it stores the data on the stream current and nozzle drive voltage magnitudes. The nozzle drive is then decremented at 58 from its high initial value (or incremented if the initial value is below the print window) and steps 52 and 54 are repeated to obtain several more data points. Preferably a sufficient number of data points should be taken in order to provide a clear measurement of the print window.

Eventually, the program detects the low end of the print window by virtue of the fact that the magnitude of the stream current has fallen markedly from its maximum value. In the event that the nozzle drive is being decremented for testing, this feature indicates that the nozzle is no longer being driven sufficiently to cause the satellites to forwardly merge. In the case where the nozzle drive is being incremented, this feature indicates that the upper bound has been reached. In either case, data sampling terminates and the program branches to 60 for calculation of the print window. This is done using standard data handling techniques whereby the data collected is converted into a set of data points on a stream current versus nozzle drive graph as shown in FIG. 2. This information can be presented to the operator on a video display or printed out as a table of values. The data, once obtained, is used to set the nozzle drive as indicated at 62 either automatically by selecting a point within the mid-range of the print window or manually should the operator of the printing device prefer. The set-up routine then ends.

Prior to initiating printing, the sensing electrode 28 is removed from the path of the charged drops. Whenever the parameters of the printer change as, for example, a new nozzle is used, a different ink is employed or a different font size is selected, the set-up routine of FIG. 3 may be initiated to ensure that the nozzle drive voltage selected is the appropriate value for the current printer setup.

Figure 7:
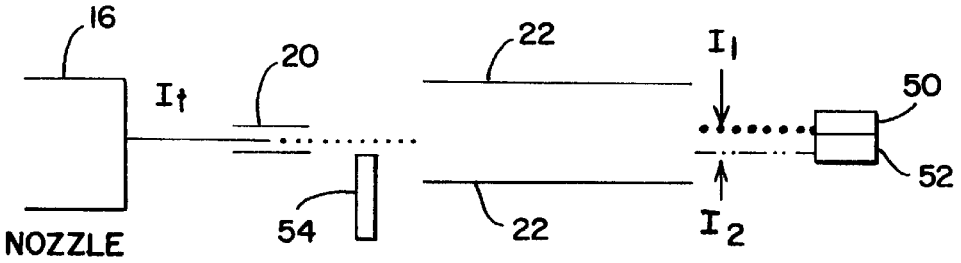
FIG. 7 is a plan view of an alternate embodiment using a two-part segmented catcher instead of a separate current electrode.
Figure 7A:
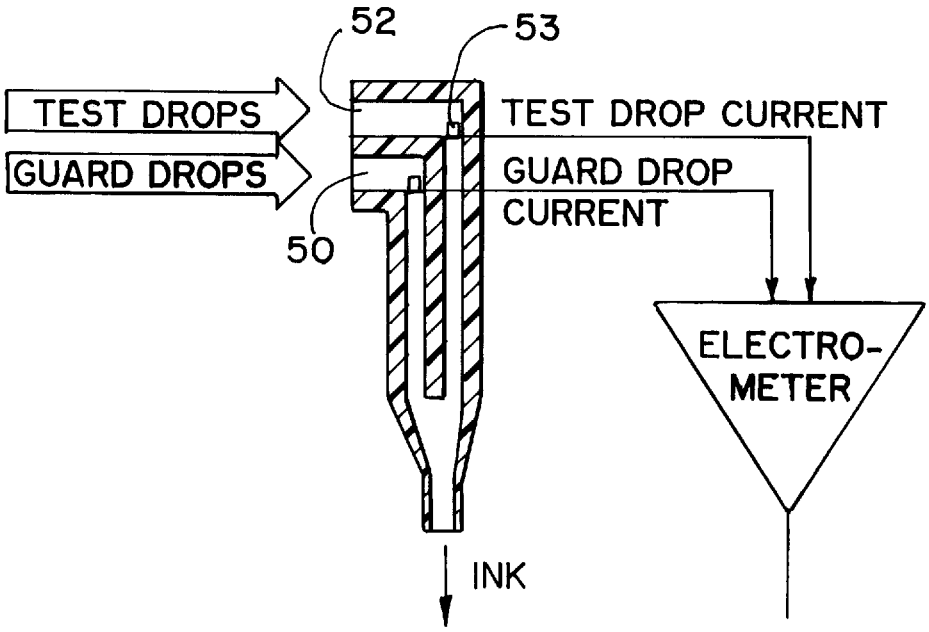
FIG. 7*a* is a side sectional view of the segmented catcher of FIG. 7.

It is also possible to deflect the charged test drops to the side of a segmented catcher. This eliminates the need for placing and removing a sensing electrode. Such an embodiment of the invention is shown in FIG. 7, a top view. As with the embodiment of FIG. 1, the nozzle 16 creates a series of drops which are charged by charge tunnel 20. A segmented catcher is provided having a main segment 50 and an auxiliary segment 52. Guard drops which are substantially uncharged pass to the main section 50 of the catcher. The auxiliary section 52 is offset to the side of the main catcher. The charged test drops are deflected to the auxiliary catcher 52 by a separate, special purpose deflection electrode 55. This electrode is operational only during the period of time when the printing window is being determined. It is positioned, as shown in FIG. 7, to deflect the test drops toward the auxiliary catcher 52. In this embodiment, the deflection electrodes 22 used for normal printing, are not operational during the print window determination sequence. The necessary current value 12 is determined by incorporating a current sensing electrode into the auxiliary catcher segment 52.

Although the set-up shown in FIG. 7 is a presently preferred embodiment, it is also possible to determine the current value $I_2$ in the FIG. 1 embodiment without a separate sensing electrode. It is possible to measure the total current $I_t$ in the ink stream 14 (see FIG. 1) and then subtract the current $I_1$ detected at the catcher. $I_1$ can be detected using an electrode incorporated into the catcher in a manner well known in this art. The value $I_t$ can be measured at the drop stream 18 in the vicinity of the charge tunnel or from the ink stream as it enters the nozzle. For this technique, the deflection voltage must be such that small satellites are not attracted to the high voltage deflection electrode. This indirect method of measuring $I_2$ does not compromise the ability of the present invention to precisely determine the print window for a given printer set up, as opposed to the more limited capability of the prior art of simply estimating the print window based on determining the foldback value.

It is also possible to practice the present invention by detecting the charge on the test drops. In that case, the electrode 28 would be replaced with a capacitive or other type charge detector located near the path of the deflected drop stream. Charged drops will induce an output proportional to the charge, the nature of the output depending on the type of detector. This permits determination of the charge magnitude which can be used, in the same way as described for the charge current, to determine the print window.

In addition to determining the print window, the routine and hardware of the present invention can be used for printer servicing to test the printer for nozzle orifice size compliance, drop spacing, charge electrode spacing and other operating parameters.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. A method for accurately determining a print range for an ink jet printer comprising the steps of:

a) generating a series of charged test drops, each of which is preceded and followed by uncharged guard drops;

b) initially setting a nozzle drive voltage to a value above an expected print range;

c) decrementing the nozzle drive voltage from said initial setting in steps;

d) determining a stream current corresponding to the charges on the test drops for each nozzle drive voltage value; and e) determining the print range as being equal to the range of nozzle drive voltages approximately corresponding to a maximum stream current.

2. The method of claim 1 further including the step of:

f) setting the nozzle drive voltage to a value within the print range for printing.

3. A method for accurately determining a print range for an ink jet printer comprising the steps of:

a) generating a series of charged test drops, each of which is preceded and followed by uncharged guard drops;

b) initially setting a nozzle drive voltage to a value below an expected print range;

c) incrementing the nozzle drive voltage from said initial setting in steps;

d) determining a stream current corresponding to the charges on the test drops for each nozzle drive voltage value; and e) determining the print range as being equal to the range of nozzle drive voltages approximately corresponding to a maximum stream current.

4. The method of claim 3 further including the step of:

f)setting the nozzle drive voltage to a value within the print range for printing.

5. The method of claim 1 wherein step d) includes the substeps of deflecting the test drops from a path of the guard drops and determining a charge on said test drops.

6. The method of claim 2 wherein step d) includes the substeps of deflecting the test drops from a path of the guard drops and determining the charge on said test drops.

7. In an ink jet printer having an ink source, a nozzle assembly for creating an ink stream which breaks into drops, a drop charging electrode, deflection electrodes, an ink catcher for uncharged drops, the improvement comprising:

a) means for generating a series of test drops charged by said charge electrode, each of said test drops being preceded and followed by uncharged guard drops;

b) means for determining a stream current carried by the charged test drops; and c) a controller for:

i) applying a series of nozzle drive voltages to said nozzle starting at an initial value;

ii) stepping the nozzle drive voltage from said initial value through an expected printing range and beyond; and iii) recording the stream current determined for each nozzle drive voltage step and determining the printing range as being equal to the range of nozzle drive voltages where the stream current is approximately equal to a maximum stream current.

8. The printer of claim 7 wherein said controller means includes means for setting the nozzle drive voltage at a value within the printing range for printing.

9. The printer of claim 7 wherein said means for determining the stream current includes an ammeter.

10. The printer of claim 7 wherein said catcher is segmented to receive the test drops and guard drops separately and includes means for measuring the charge on said test drops;

said printer further including an additional deflection electrode positioned to deflect said charged test drops to said catcher measuring means.

11. The printer of claim 7 wherein said means for determining includes:

a) means associated with said catcher for measuring an amount of stream current $I_1$ transferred to said guard drops;

b) means associated with the ink stream for measuring a total current, $I_t$, thereby to determine the stream current of said test drops as being equal to $(I_t - I_1)$.

12. The method of claim 1 where step d) includes the substep of separating said charged test drops from said uncharged guard drops.

13. The method of claim 3 where step d) includes the substep of separating said charged test drops from said uncharged guard drops.

14. The printer according to claim 7 wherein said means for determining includes means for separating said charged test drops from said uncharged guard drops.

* * * * *